US008800901B2

(12) United States Patent
Nied et al.

(10) Patent No.: US 8,800,901 B2
(45) Date of Patent: Aug. 12, 2014

(54) PULVERIZER AND OPERATING METHOD THEREFOR

(75) Inventors: Roland Nied, Bonstetten (DE); Wolfgang Rohmann, Offenbach (DE); Hermann Sickel, Gambach/Münzenberg (DE); Thomas Becker, Vacha (DE)

(73) Assignees: Roland Nied (DE); Netzsch-Condux Mahltechnik GmbH (DE)

( * ) Notice: Subject to any disclaimer, the term of this patent is extended or adjusted under 35 U.S.C. 154(b) by 406 days.

(21) Appl. No.: 12/626,317

(22) Filed: Nov. 25, 2009

(65) Prior Publication Data

US 2010/0127105 A1 May 27, 2010

(30) Foreign Application Priority Data

Nov. 26, 2008 (DE) ..... 10 2008 059 114
Mar. 12, 2009 (DE) ..... 10 2009 012 743

(51) Int. Cl.
*B02C 18/22* (2006.01)

(52) U.S. Cl.
USPC ..... 241/57; 241/65; 241/73; 241/242

(58) Field of Classification Search
USPC ..... 241/73, 242, 243, 57, 65
See application file for complete search history.

(56) References Cited

U.S. PATENT DOCUMENTS

| | | | | | |
|---|---|---|---|---|---|
| 1,423,867 | A | * | 7/1922 | Winston et al. | 241/167 |
| 1,917,198 | A | * | 7/1933 | Scheynost | 241/243 |
| 2,821,468 | A | * | 1/1958 | Grady | 75/361 |
| 4,073,444 | A | * | 2/1978 | Pav | 241/73 |
| 4,077,573 | A | * | 3/1978 | Kersey et al. | 241/32 |
| 4,198,005 | A | * | 4/1980 | Eiff | 241/73 |
| 4,241,881 | A | * | 12/1980 | Laumer | 241/28 |
| 4,819,331 | A | * | 4/1989 | Joyama | 30/120.2 |
| 5,402,948 | A | * | 4/1995 | Kaczmarek | 241/73 |
| 6,094,795 | A | * | 8/2000 | Davenport | 29/407.1 |
| 6,415,999 | B1 | * | 7/2002 | Nied | 241/79.1 |
| 7,832,667 | B2 | * | 11/2010 | Doppstadt et al. | 241/73 |

FOREIGN PATENT DOCUMENTS

| | | | |
|---|---|---|---|
| DE | 1086051 | B | 7/1960 |
| DE | 19954998 | A1 | 5/2001 |
| DE | 19961882 | A1 | 6/2001 |
| DE | 10222814 | A1 | 12/2003 |

* cited by examiner

*Primary Examiner* — Mark Rosenbaum
(74) *Attorney, Agent, or Firm* — St. Onge Steward Johnston & Reens LLC

(57) ABSTRACT

A pulverizer includes a cutting rotor with a multiplicity of cutting blades, a cutting stator surrounding the cutting rotor with a plurality of stator blades, a milling stock inlet for the milling stock feed and a discharge screen in direction of rotation of the cutting rotor located after the milling stock inlet, wherein all stator blades in direction of rotation of the cutting rotor are arranged between the milling stock inlet and the discharge screen. Furthermore, an operating method for a pulverizer as described above is also contemplated.

15 Claims, 2 Drawing Sheets

PULVERIZER AND OPERATING METHOD THEREFOR

CROSS-REFERENCE TO RELATED APPLICATIONS

The present application claims priority of German patent application No. 10 2009 012 743.7 filed on Mar. 12, 2009 and German patent application No. 10 2008 059 114.9 filed on Nov. 26, 2008, the content of which is incorporated herein by reference.

FIELD OF THE INVENTION

The present invention relates to a pulverizer and an operating method for a pulverizer.

BACKGROUND OF THE INVENTION

Pulverizers, such as for example cutting mills, are known and serve for the reduction of plastic wastes and corresponding cuttable materials in form of fibres, pieces, hollow bodies, foils and profile material but also of natural and synthetic rubber, vulcanised rubber, cable wastes, glass fibre wastes, leather or paper to state but a few concrete examples.

DE 199 54 998 A1 discloses a cutting mill which includes a cutting rotor with a multiplicity of cutting blades evenly distributed over its circumference, a cutting stator surrounding the cutting rotor with a plurality of stator blades, a milling stock inlet for milling stock feed and a discharge screen. As for the rest, this publication deals with the configuration of an additionally included rotating classifying device and its arrangement together with the cutting rotor in a common housing.

SUMMARY OF THE INVENTION

The present invention therefore has the objective of further developing a pulverizer and an operating method therefor in such a manner that better and more even milling of milling stock is achieved.

This objective is achieved with a pulverizer and operating methods of a pulverizer according to the present invention.

With a generic pulverizer including a cutting rotor with a multiplicity of cutting blades more preferably evenly distributed over its circumference, a cutting stator surrounding the cutting rotor with a plurality of stator blades, a milling stock inlet for milling stock feed and a discharge screen located in direction of rotation of cutting rotor after the milling stock inlet, it is thus further provided according to the invention that all stator blades are arranged in direction of rotation of cutting rotor between the milling stock inlet and the discharge screen.

Preferentially with such a pulverizer it can be further provided that a housing is included in which the discharge screen is fixedly installed.

A further preferred embodiment is to be seen in that the milling stock inlet is a first milling stock inlet and that in the direction of rotation of the cutting rotor after the first milling stock inlet and before the discharge screen at least one further milling stock inlet for milling stock feed is arranged, wherein furthermore preferentially in direction of rotation of the cutting rotor after the first milling stock inlet and before the discharge screen a plurality of milling stock inlets for milling stock feed can be arranged. These versions can be further developed in that the housing in front of the second milling stock inlet in direction of rotation of the cutting rotor located after the first milling stock inlet is designed coolable, wherein additionally preferentially for the cooling of the housing cooling devices are provided which include a hollow shaped body in front of the second milling stock inlet and wherein furthermore more preferably the cooling devices are designed so that a gas or a fluid flows through the hollow shaped body.

Yet another preferential embodiment consists in that a separate process gas inlet for the process gas feed can be assigned to each milling stock inlet, wherein more preferably each process gas inlet in direction of rotation of the cutting rotor can be arranged in front of the corresponding milling stock inlet.

A further embodiment thereof can provide that the housing in front of the second process gas inlet located in direction of rotation of the cutting rotor after the first process gas inlet is embodied coolable, wherein further preferably for the cooling of the housing cooling devices are provided, include a hollow shaped body in front of the second process gas inlet and wherein more preferably in addition the cooling devices are designed so that a gas or a fluid flows through the hollow shaped body.

It can further be preferentially provided that at least one process gas inlet for the process gas feed is arranged between the if applicable first milling stock inlet and the discharge screen.

According to yet another preferred embodiment an end wedge can be associated with the end of the discharge screen located in direction of location of the cutting rotor, wherein the end wedge preferentially is designed knife-like and/or in direction of rotation of the cutting rotor following the discharge screen a process gas inlet for the process gas feed, the end wedge and then the if applicable first milling stock inlet can be arranged in succession.

Furthermore the pulverizer can be designed or serve for the reduction of fibrous goods.

Through the invention, in order to achieve the above objective, an operating method for a pulverizer is additionally created which includes a cutting rotor with a multiplicity of cutting blades more preferably evenly distributed over its circumference, a cutting stator surrounding the cutting rotor with a plurality of stator blades, a milling stock inlet for the milling stock feed and a discharge screen in direction of rotation of the cutting rotor located after the milling stock inlet, wherein all stator blades in direction of rotation of the cutting rotor are arranged between the milling stock inlet and the discharge screen, and wherein at least two process gas inlets for the process gas feed are provided, and with which method process gas through all existing process gas inlets is fed into the pulverizer in at least approximately equal parts.

A preferred further embodiment of the above method can be achieved in that a first process gas inlet is assigned to the milling stock inlet and more preferably in direction of rotation of the cutting rotor is connected upstream, and that all other process gas inlets are arranged between the milling stock inlet or the first process gas inlet and the discharge screen.

To achieve the above objective the invention also creates an operating method for a pulverizer including a cutting rotor with a multiplicity of cutting blades more preferably distributed evenly over its circumference, a cutting stator surrounding the cutting rotor with a plurality of stator blades, a plurality of milling stock inlets for the milling stock feed and a discharge screen in direction of rotation of the cutting rotor located after the milling stock inlets, wherein all stator blades are arranged in direction of rotation of the cutting rotor between the direction of rotation of the cutting rotor first milling stock inlet and the discharge screen, and which method further provides that milling stock is fed into the pulverizer through all existing milling stock inlets in at least approximately equal parts.

Further preferred and/or advantageous embodiments of the invention are obtained from the claims and their combinations as well as from the entire application documents in hand.

BRIEF DESCRIPTION OF THE DRAWINGS

In the following, the invention is explained in more detail by means of an exemplary embodiment merely exemplarily making reference to the drawing, wherein.

DETAILED DESCRIPTION OF THE INVENTION

Figure 1:
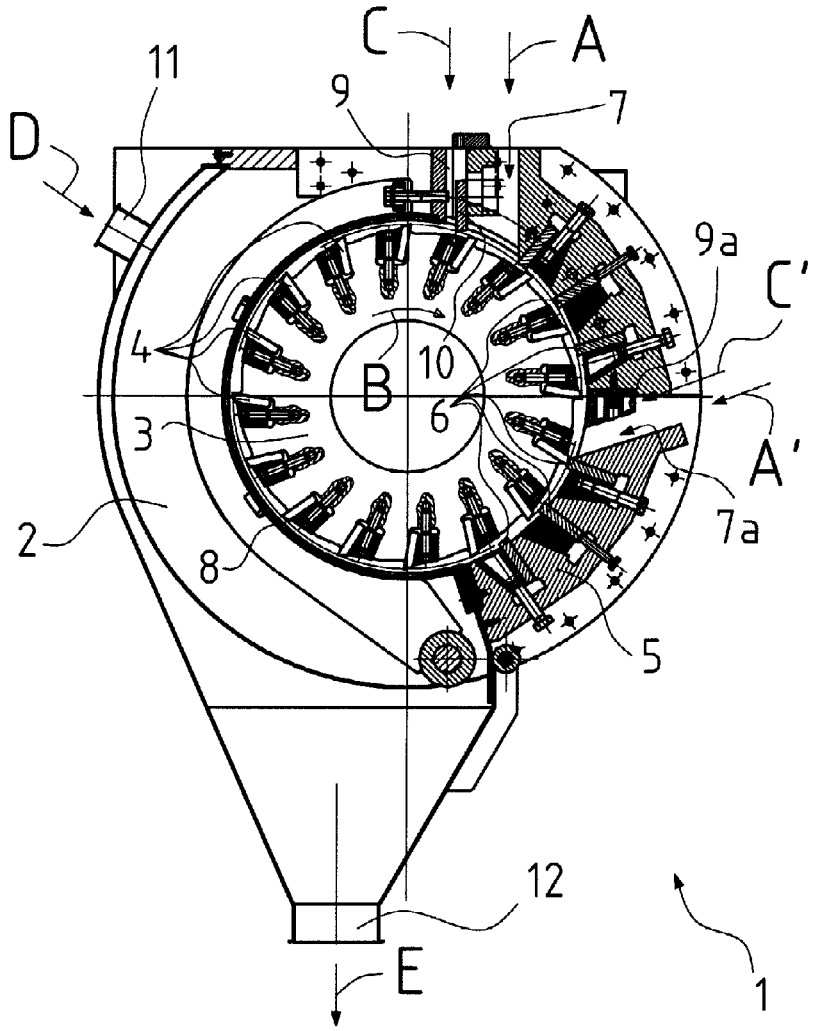
FIG. 1 shows a first exemplary embodiment of a pulverizer in a schematic cross section.

By means of the exemplary embodiments and exemplary applications described in the following and shown in the drawings the invention is explained in more detail merely exemplarily, i.e. it is not restricted to these exemplary embodiments and exemplary applications or to the respective feature combinations within said exemplary embodiments and exemplary applications. Method and device features in each case are similarly also obtained from device and method descriptions.

Individual features which state and/or are shown in connection with a concrete exemplary embodiment are not restricted to this exemplary embodiment or the combination with the remaining features of this exemplary embodiment, but can be combined within the scope of the technical possibilities with other exemplary embodiments and exemplary applications or individual features and feature combinations thereof and/or any known versions even if these are not separately treated in the documents in hand.

By means of the representations in the drawing features which are not provided with reference symbols also become clear irrespective of whether such features are described in the following or not. On the other hand, features which are included in the present description but are not visible or shown in the drawing are understandable to a person skilled in the art without any problems.

FIG. 1 shows a first exemplary embodiment of a pulverizer 1 for the reduction of fibrous goods in a schematic cross section. The invention is not restricted to a pulverizer 1 for the reduction of fibrous goods but also relates to pulverizers for other applications. The pulverizer 1 includes a housing 2, a cutting rotor 3 with a multiplicity of cutting blades 4 evenly distributed over its circumference, a cutting stator 5 surrounding the cutting rotor 3 with a plurality of stator blades 6, a milling stock inlet 7 for the milling stock feed or for the product inlet according to the arrow A and a discharge screen 8 in direction of rotation of the cutting rotor 3 according to the arrow B located after the milling stock inlet 7 which is fixedly installed in the housing 2. All stator blades 6 are arranged in direction of rotation of the cutting rotor 3 according to the arrow B between the milling stock inlet 7 and the discharge screen 8.

With the first embodiment version shown in FIG. 1 the milling stock inlet 7 constitutes a first milling stock inlet which in direction or rotation of the cutting rotor 3 according to the arrow B is located between the discharge screen 8 and the in direction of rotation of the cutting rotor 3 according to the arrow B first stator blade 6. A further milling stock inlet 7*a* for the milling stock feed or for the product inlet according to an arrow A' with this first exemplary embodiment is arranged between the in direction of rotation of the cutting rotor 3 according to the arrow B fourth and fifth stator blade 6. The concrete quantity and arrangement of the plurality of milling inlets can advantageously be provided and/or employed in coordination with the milling stock and the milling process as well as the milling result.

According to the method it is hereby divided that milling stock is fed into the pulverizer 1 through all existing or in the present case specifically the two milling stock inlets 7 and 7*a* in at least approximately equal parts. Additional milling stock inlets in direction of rotation of the cutting rotor 3 according to the arrow B can be arranged after the first milling stock inlet 7 and in front of the discharge screen 8. As alternative method embodiment it can also be provided that milling stock is fed into the pulverizer 1 completely, more preferably optionally through a milling stock inlet 7 or 7*a,* wherein both method versions can be realised with one and the same pulverizer 1 through suitable control possibilities. Such control possibilities including the appropriate structural prerequisites and requirements are known to the person skilled in the art per se, so that this does not require further discussion here.

The pulverizer 1 according to the first exemplary embodiment shown in FIG. 1 furthermore includes a separate process gas inlet 9, 9*a* for the process gas feed according to the arrow C and C' respectively for each milling stock inlet 7, 7*a*. The relation between the milling stock inlets 7, 7*a* on the one hand and the process gas inlets 9, 9*a* on the other hand is such that the milling stock inlet 7 is assigned the process gas inlet 9 and that the milling stock inlet 7*a* is assigned the process gas inlet 9*a*. The arrangement of the process gas inlets 9, 9*a* is such that each process gas inlet 9 in direction of rotation of the cutting rotor 3 according to the arrow B is arranged in front of the corresponding milling stock inlet 7. With a plurality of milling stock inlets provided corresponding process gas inlets can be assigned to each milling stock inlet or only to some milling stock inlets. Furthermore, at least one process gas inlet for the process gas feed can be arranged between the milling stock inlet 7 and the discharge screen 8 without any assignment to a further milling stock inlet.

Furthermore, the pulverizer 1 of the first exemplary embodiment according to FIG. 1 includes an end wedge 10, which is assigned to the end of the discharge screen 8 located in direction of rotation of the cutting rotor 3 according to the arrow B. This end wedge 10 is designed blade-like. The arrangement realized with this is such that in direction of rotation of the cutting rotor 3 according to the arrow B following the discharge screen 8 the process gas inlet 9 for the process gas feed according to the arrow C, the blade-like or blade-shaped end wedge 10 and then the first milling stock inlet 7 for the milling stock feed or for the product inlet according to the arrow A are arranged in succession.

In addition to the configuration possibilities of the operating method for a pulverizer 1 according to the present invention explained further up, yet further method versions are created.

With a pulverizer 1 which includes a cutting rotor 3 with a multiplicity of cutting blades 4 more preferably evenly distributed over its circumference, a cutting stator 5 surrounding the cutting rotor 3 with a plurality of stator blades, a milling stock inlet 7 for the milling stock feed and a discharge screen 8 located in direction of rotation of the cutting rotor 3 according to the arrow B after the milling stock inlet 7, wherein according to the present invention all stator blades 6 in direction of rotation of the cutting rotor 3 are arranged between the milling stock inlet 7 and the discharge screen 8 and wherein at least two process gas inlets 9 for the process gas feed are provided, the operating method can be such that process gas is fed into the pulverizer 1 through all existing process gas inlets 9, 9*a* in at least approximately equal parts. In a corresponding version, this method also applies to an embodiment of the pulverizer 1, wherein the first process gas inlet 9 is assigned to the first milling stock inlet 7 and more preferably in direction of rotation of the cutting rotor 3 according to the arrow B connected upstream, and wherein all other process gas inlets 9*a* are arranged between the first milling stock inlet 7 or the first process gas inlet 9 and the discharge screen 8.

For the sake of completeness reference is additionally made to an auxiliary air inlet 11 for the entry of auxiliary air according to the arrow D and a product run-out according to the arrow E, which are provided with this exemplary embodiment according to the representation in FIG. 1.

Figure 2:
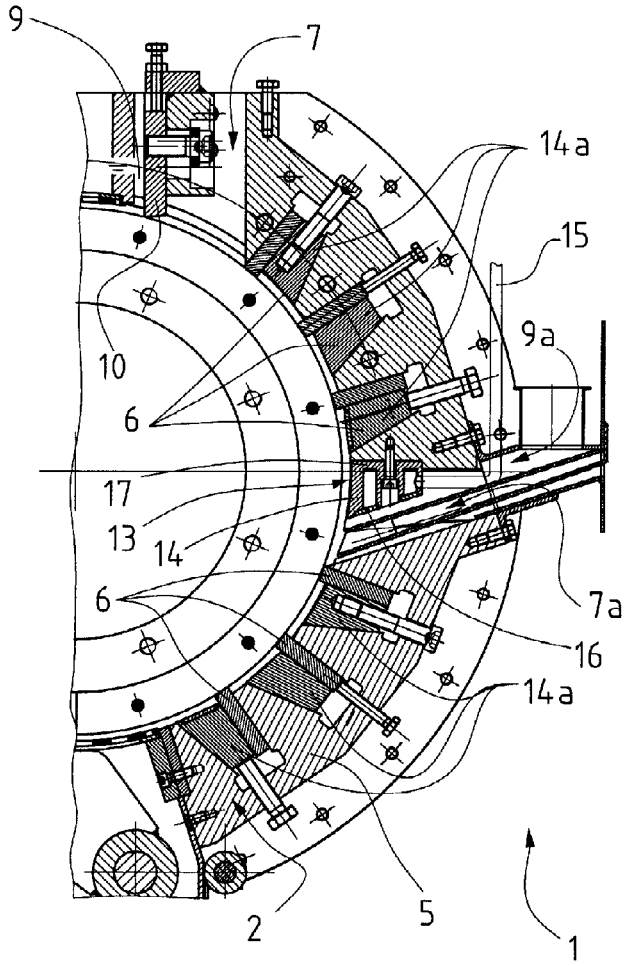
FIG. 2 shows a second exemplary embodiment of a pulverizer in a schematic and partial cross section.
Figure 3:
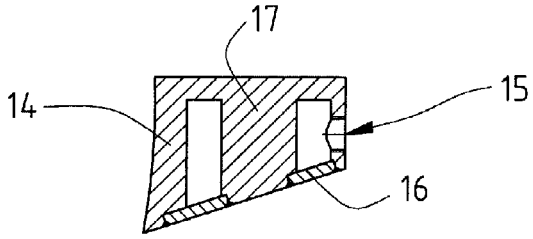
FIG. 3 shows a detail of the second exemplary embodiment of the pulverizer according to FIG. 2 in a schematic cross section.

A second exemplary embodiment of a pulverizer 1 is shown in FIG. 2 in a schematic and, with respect to the view of the first exemplary embodiment in FIG. 1, partially cross-sectional view. FIG. 3 likewise in a schematic cross-sectional view in an enlarged representation shows a detail of the second exemplary embodiment according to FIG. 2.

Insofar as with the second exemplary embodiment according to FIG. 2 features, feature combinations, functions and effects are identical or similar to those of the first exemplary embodiment according to FIG. 1, this becomes easily clear through the use of the same reference symbols and/or evidently identical or similar representation, without a detailed description of the second exemplary embodiment according to FIG. 2 or in each case a specific reference to identical or similar features, feature combinations, functions and effects with respect to the first and second exemplary embodiments would be again required for identification or understanding. For the sake of completeness, to the extent that this is applicable, reference is made to the above information and explanations with respect to the first exemplary embodiment according to FIG. 1 to explain the second exemplary embodiment according to FIG. 2, in order to avoid a mere repetition. For this reason, only the features are discussed in the following which are new with the second exemplary embodiments according to FIG. 2 compared with the first exemplary embodiment according to FIG. 1.

In addition to the features of the first exemplary embodiment according to FIG. 1 the pulverizer 1 within the scope of its second exemplary embodiment according to FIG. 2 includes cooling devices 13 which include a hollow shaped body 14 in front of the second process gas inlet 9*a* and in front of the second milling stock inlet 7*a* in the direction of rotation of the cutting rotor (not shown) located after that, and coolant lines 15. The coolant lines 15 are laid out and connected so that coolant, which can be a gas or a fluid, flows through the hollow shaped bodies 14, 14*a*. The hollow shaped bodies 14, 14*a* can be designed integrally in the housing 2 or directly in the cutting stator 5 or constitute a separate component; in both cases the hollow space contained in the hollow shaped body 14 can be closed off in a basic body 17 to accommodate the coolant and to realize its cooling effect for example through a lid 16 welded in all round.

By means of the exemplary embodiments in the description and in the drawing the invention is merely shown exemplarily and not restricted to that, but comprises all variations, modifications, substitutions and combinations which the person skilled in the art can glean from the present documents, more preferably within the context of the claims and the general representations in the introduction of this description as well as the description of the exemplary embodiments and their representations in the drawing and combine with his expert knowledge and the prior art. More preferably, all individual features and embodiment possibilities of the invention and its embodiment versions are combinable.

What is claimed is:

1. A pulverizer comprising:

a cutting rotor having a plurality of cutting blades;

a cutting stator surrounding the cutting rotor, the cutting stator having a plurality of stator blades spaced apart in a direction of rotation of the cutting rotor;

a milling stock inlet for milling stock feed;

a discharge screen in the direction of rotation of the cutting rotor located after the milling stock inlet; and an end wedge assigned to an end of the discharge screen located in the direction of rotation of the cutting rotor;

wherein the plurality of stator blades in the direction of rotation of the cutting rotor are arranged only after the milling stock inlet and before the discharge screen.

2. The pulverizer of claim 1, further comprising a housing, the discharge screen being fixedly installed in the housing.

3. The pulverizer of claim 1, wherein the milling stock inlet is a first milling stock inlet and the pulverizer further comprises at least one second milling stock inlet, the at least one second milling stock inlet being arranged after the first milling stock inlet and in front of the discharge screen in the direction of rotation of the cutting rotor.

4. The pulverizer of claim 3, further comprising a plurality of second milling stock inlets for milling stock feed arranged in the direction of rotation of the cutting rotor after the first milling stock inlet and in front of the discharge screen.

5. The pulverizer of claim 4, wherein each milling stock inlet is assigned a separate process gas inlet for process gas feed.

6. The pulverizer of claim 5, wherein the process gas inlet is a first process gas inlet and the pulverizer further comprises a housing in front of a second process gas inlet located in the direction of rotation of the cutting rotor after the first process gas inlet, the housing being coolable.

7. The pulverizer of claim 6, further comprising cooling devices for cooling the housing, the cooling devices having hollow shaped bodies in front of the second process gas inlet.

8. The pulverizer of claim 7, wherein the cooling devices are designed so that a gas or a fluid flows through the hollow shaped bodies.

9. The pulverizer of claim 5, wherein each process gas inlet in the direction of rotation of the cutting rotor is arranged in front of the corresponding milling stock inlet.

10. The pulverizer of claim 5, wherein at least one process gas inlet for the process gas feed is arranged between the first milling stock inlet and the discharge screen.

11. The pulverizer of claim 3, further comprising a housing in front of the second milling stock inlet in the direction of rotation of the cutting rotor located after the first milling stock inlet, the housing being coolable.

12. The pulverizer of claim 11, further comprising cooling devices for cooling the housing, the cooling devices having hollow shaped bodies in front of the second milling stock inlet.

13. The pulverizer of claim 12, wherein the cooling devices are designed so that a gas or a fluid flows through the hollow shaped bodies.

14. The pulverizer of claim 1, wherein the end wedge is blade-like.

15. The pulverizer of claim 1, wherein a process gas inlet for process gas feed, the end wedge and the milling stock inlet are arranged in succession in the direction of rotation of the cutting rotor following the discharge screen.

* * * * *